US007165926B2

(12) United States Patent
Rieck et al.

(10) Patent No.: US 7,165,926 B2
(45) Date of Patent: Jan. 23, 2007

(54) METHOD FOR FIXING THE POSITION OF A TAB HAVING AN ANTI-ROTATION BEAD FORMED FROM THE PANEL OF A SHEET METAL LID (STEEP ANTI ROTATION DEVICE).

(76) Inventors: Hajo Rieck, Schloss Gelsdorf, Herrenhaus, 53501 Gelsdorf (DE); Martin Gray, 7 Forest Road, Woodlands Estate, Llay, Wrexham, Flintshire, LL 12 OUB (GB); Richard Chalk, 8 Llys Argoed, Mynydd Isa, Mold, Flintshire, CH7 6TX (GB)

( * ) Notice: Subject to any disclaimer, the term of this patent is extended or adjusted under 35 U.S.C. 154(b) by 162 days.

(21) Appl. No.: 11/184,007

(22) Filed: Nov. 3, 2003

(65) Prior Publication Data

US 2006/0010956 A1 Jan. 19, 2006

(51) Int. Cl.
*B21D 51/44* (2006.01)
*B65D 17/34* (2006.01)

(52) U.S. Cl. ..... 413/12; 220/269; 72/379.4

(58) Field of Classification Search ..... 413/12, 413/14; 220/269; 72/379.4
See application file for complete search history.

(56) References Cited

U.S. PATENT DOCUMENTS 3,780,902 A 12/1973 Holc et al.
3,782,586 A * 1/1974 Brown ..... 220/270
3,785,522 A 1/1974 Prayer et al.
3,868,918 A * 3/1975 Smith et al. ..... 413/14
3,871,314 A * 3/1975 Stargell ..... 413/13
3,967,754 A 7/1976 Ostrem
4,416,389 A 11/1983 Wilkinson et al.
4,455,114 A * 6/1984 Zysset ..... 413/14
4,535,909 A 8/1985 Zysset
4,596,342 A * 6/1986 Zysset ..... 220/273
4,826,037 A * 5/1989 La Croce ..... 220/273
5,129,541 A 7/1992 Voigt et al.
5,494,184 A 2/1996 Noguchi et al.

(Continued)

FOREIGN PATENT DOCUMENTS

DE 7018731 U 8/1970

(Continued)

OTHER PUBLICATIONS

U.S. Appl. No. 11/089,591 to Rieck et al., filed Nov. 3, 2004.

*Primary Examiner*—Lowell A. Larson
(74) *Attorney, Agent, or Firm*—Greenblum & Bernstein, P.L.C.

(57) ABSTRACT

Method for shaping a sheet metal lid, preferably for a beverage can, which includes a panel, an openable area defined in the panel by a score line, and a mounting place for a tab for breaking into the openable area. At least one projection in the panel is shaped twice, such that a pre-form of the projection is shaped out of the panel of the sheet metal lid, in which the pre-form is located near an attaching portion of the tab, but at a distance from a the mounting place, and at least a front edge of the pre-form of at least one projection is re-formed, so that no score line is provided in the panel during shaping or re-forming. Further, to obtain better blocking of an outer edge portion of the attaching portion, an outer edge portion is associated with the re-formed front edge. This abstract is neither intended to define the invention disclosed in this specification nor intended to limit the scope of the invention in any way.

11 Claims, 5 Drawing Sheets

U.S. PATENT DOCUMENTS

| | | | |
|---|---|---|---|
| 5,799,816 | A | 9/1998 | Schubert |
| 2006/0016815 | A1 | 1/2006 | Rieck et al. |

FOREIGN PATENT DOCUMENTS

| | | | |
|---|---|---|---|
| DE | 2 008 138 | | 9/1971 |
| DE | 21 00 580 | | 10/1971 |
| DE | 7127606 | U | 10/1971 |
| DE | 2 024 535 | | 12/1971 |
| DE | 7212780 | U | 8/1972 |
| DE | 2 256 498 | | 11/1972 |
| DE | 7227762 | U | 11/1972 |
| DE | 22 60 375 | | 6/1974 |
| JP | 8 053 131 | | 2/1996 |
| JP | 9 226 762 | | 9/1997 |

* cited by examiner

METHOD FOR FIXING THE POSITION OF A TAB HAVING AN ANTI-ROTATION BEAD FORMED FROM THE PANEL OF A SHEET METAL LID (STEEP ANTI ROTATION DEVICE).

BACKGROUND OF THE INVENTION

1. Field of the Invention

The invention relates to the method of positionally fixing a tab on a sheet metal lid for attaching to a body of a beverage can.

2. Discussion of Background Information

When the tab is in an attached condition to the sheet metal lid, it is known by the expert as a SOT (Stay on Tab), which is provided for opening an openable area in the surface of a lid (usually designated as "panel"). For this purpose, the tab is taken at a grip end and raised with a vertical tilting motion for breaking open an openable area along a line of weakness (usually called score line) with its opening end.

Particularly when large opening ends (LOEs) are used for the openable area, difficulties are encountered in the related art when fixing the positions of the tab in an attached condition to the sheet metal lid. Suggestions on this topic have already been made, for example in U.S. Pat. No. 5,799,816 (Schubert). In this document, a breaking-through of an attaching portion of the tab is proposed, which attaching portion is usually designated as "rivet island". The attaching portion is secured to the panel of the sheet metal lid through a shaped rivet and overlaps a round to elongated reformed bead with an opening provided in the attaching portion. The bead may also be formed after attaching the tab, compare column 3, lines 63–67, column 5, lines 37–44, claim 3 of the above-noted document and the associated graphical illustration in FIGS. 2 and 4 thereof.

The invention addresses the technical problem of achieving the same effect, but with an improved manufacture and reliability of the anti-rotation block and with an improved positional alignment of the tab in the attached condition. For this purpose, a method is proposed.

SUMMARY OF THE INVENTION

The present invention improves the positional alignment of a tab in an attached condition arranged on a panel, as well as improves the manufacture and reliability of the anti-rotation block.

According to one feature of the invention, an already present peripheral edge on a usual tab is used, the edge not having to be specifically embodied additionally for obtaining the rotation barrier after the attachment of the tab to the panel ("staking"). The only manipulation is effected on the sheet metal lid itself, which is provided with a shape, as is the rivet in a preliminary phase, which shape may also be pre-formed together with the formation of the rivet and subsequently modified in shape, or more precisely "reformed", in a further processing step of the sheet metal lid being manufactured. The projection may thus be formed integrally with the sheet metal lid, as is the securing point by one-piece manufacturing for the attaching portion of the tab.

The projection does not protrude through an opening of the attaching portion, and the attaching portion is not provided with an opening beforehand, but the attaching portion remains entire and a blocking device that acts on the attaching portion from an outside is provided.

It is advantageous if at least one of the projections has an asymmetrical cross section, having a steeper flank facing the attaching portion than the flank facing away from the attaching portion. Such a shape may also be selected for punctiform or oval projections.

In a subsequent reshaping, reforming, or post-forming, the thickness of a top side of the (strip-shaped) projection is reduced. Thereby, solidification of the portion as well as of the projection as a whole is achieved. This also applies to the method. The score line may be introduced not simultaneously with the reforming, in temporally shifted or offset processing steps. The same is valid for the pre-forming of the bead, which is not shaped at the same time, as the score line is introduced.

In order to obtain the blocking effect, which may also be a limiting effect, which is to be understood such as to completely prevent a rotating movement up to substantially limit the rotating movement, an outer edge of the flat attaching portion (rivet island) abuts against the projection that is shaped to protrude out of the sheet metal lid.

The projection may have strip shape (line shape) and be aligned transversely and/or parallel to a longitudinal extension of the tab (longitudinal axis or longitudinal plane), engaging at a correspondingly aligned peripheral edge of the attaching portion for its blocking effect or being provided very closely adjacent thereto. In a longitudinal extension, the projection may extend over more than 30%, or possibly over more than 50% to more than 80% of the width of the attaching portion.

Several projections may be provided, not all projections having to be assigned to the same outer edge portion of the attaching portion. The projections may also be differently embodied, i.e. strip-shaped, round to oval, or a combination thereof. If a line-shaped outer edge portion of the attaching portion is provided, a line-shaped (strip-shaped) embodiment of the projections may be advantageous. The line-shaped strip design may also be achieved by arranging at least two punctiform projections in line, which then form a group that is assigned to the same outer edge portion of the attaching portion.

If several projections are provided according to the description given hereinbefore, they do not have to engage the same edge line of the attaching portion at the start of a rotating movement, but instead may be assigned to different outer edges. If a strip shape is provided for a projection, it may be designed to have a length longer than the diameter of the finished rivet head.

The attaching portion being formed from a piece of the central portion of the tab, only minor gaps are visible between the attaching portion, which is displaced downwards to a lower plane by a double buckling line, and the somewhat higher, parallel plane of the rest of the tab. Accordingly, the mounting of the projections on at least one of the free peripheral edges facing outward from the attaching portion is barely or only poorly visible from the outside, so that the rotation blocking is virtually invisible to the observer. A colored tab is not changed further in its colored shape.

BRIEF DESCRIPTION OF THE DRAWINGS

Reference is made to the content of the disclosure of the co-pending US application (as mentioned in the introductory part). The present invention is further described in the detailed description which follows, in which like reference numerals represent similar parts throughout the several views of the drawings, and wherein:

FIG. 4*a* is a cross section along line C—C in FIG. 4;

FIG. 6*a* is a cross section of an embodiment of the invention corresponding to the illustration in FIG. 6.

DETAILED DESCRIPTION OF THE PRESENT INVENTION

Figure 1:
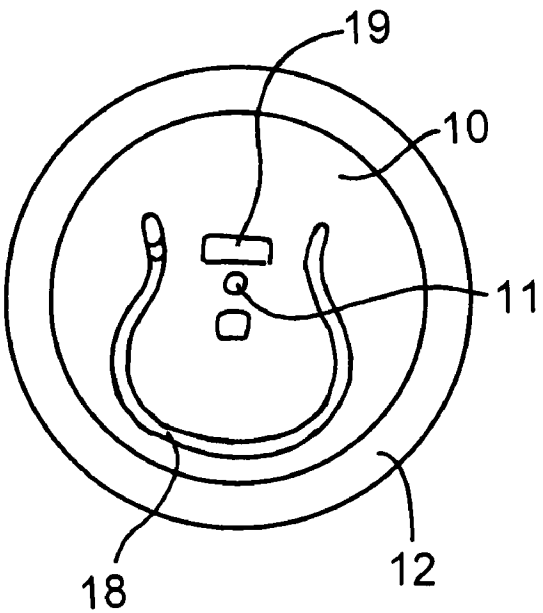
FIG. 1*a* shows the first stage of three stages in a manufacturing process of a sheet metal lid, which introduces, in part, a seamable edge, a U-shaped bead, a mounting place and projections.

FIGS. 1*a* to 3*a* show the sheet metal lid according to a method having a visible edge portion 12 as a seamable edge suitable for seaming to the body of a beverage can. The sheet metal lid itself is produced from thin sheet metal, typically less than 0.24 mm, and has already passed through preceding workstations before reaching the stage shown in FIG. 1*a*. The lid comprises an inner surface portion (panel) 10 surrounded by a seamable edge 12. Within said panel 10, a weakening line 16 is to be introduced around an openable area, the openable area being surrounded by a substantially U-shaped bead 18. Within the bead, which opens in the center portion of the panel, a substantially oval weakening line 16 is to be designed as a score line, having a transitional section that is not scored and thus serves as a connecting portion to the rest of panel 10 when the openable area 17 is broken in along the score line 16 by the effect of a tab, which will be explained later. This is illustrated in FIG. 2*a*.

Figure 4:
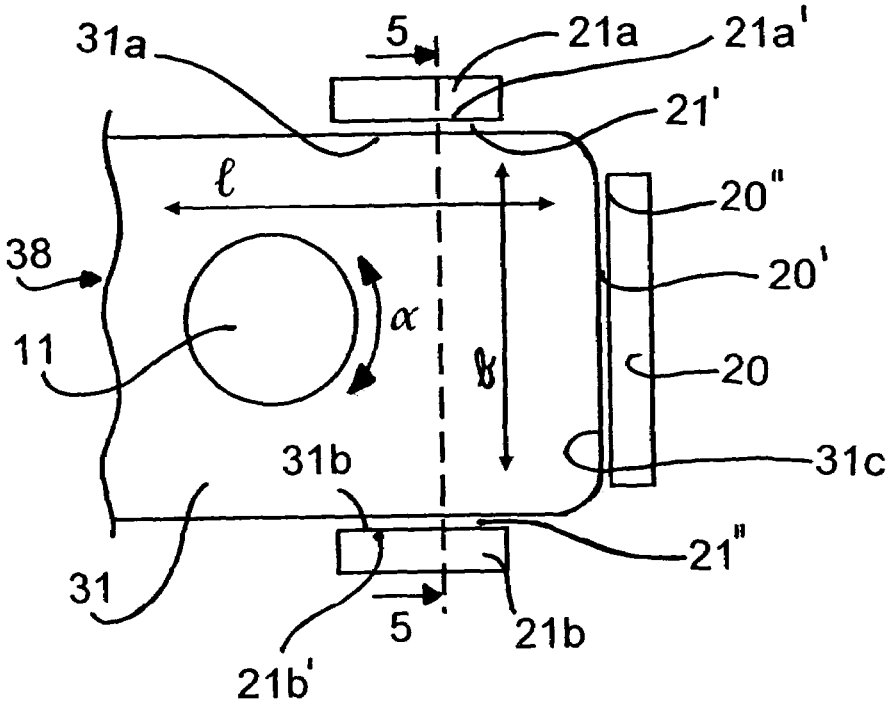
FIG. 4 is an enlarged section from FIG. 3*a*, particularly showing the panel that includes an attaching portion 31 and the rivet 11 as mounting place.

FIG. 4 shows a mounting place 11, which is visible more clearly in the sectional enlargements of the main application, is provided approximately in the middle of the panel. An attaching portion 31 as a sheet metal tongue is associated schematically therewith, the attaching portion being part of the tab according to FIG. 4, on which it is formed integrally via an articulation line as a buckling line 38. The tab 30 comprises a grip portion 32, provided here with a circular opening, at which the tab is operated by the user for breaking open the score line 16 according to FIG. 2*a*. The tab 30 also comprises an opening nose portion 33 before the attaching portion 31, the opening portion being located as a break-in nose above the openable area 17, for which purpose an additional, eyeball-shaped bead 18*a* as shown in FIG. 2*a* is provided in a separate working step, the bead reinforcing the transverse LOE openable area, for being able to apply the opening forces to the break-open starting portion (loop-shaped end of the score line 16). The mounted tab 30 is substantially parallel to the panel, which itself does not have to be designed exactly in one plane, but may be slightly bulged, though the area around the mounting place 11 is substantially planar, allowing a substantially parallel arrangement of the attaching tongue 31 of the tab 30. Further, FIG. 4 is of the parallel US provisional, which the complete content is made reference, and shows a subsequent manufacturing station, at which a tab 30 is mounted using a rivet 11 integrally formed on the sheet metal lid, via an attaching portion 31, which as a flat attachment tongue (rivet island) serves for mounting ("staking").

According to the FIGS. 1*a* to 3*a*, at least one of the three strip-shaped projections 20 are re-formed as upwardly protruding beads (i.e. towards the outside of the sheet metal lid) around the mounting place 11. The bead 20, extending transversely to the midplane 100, is longer than the two neighboring beads, which extend parallel to the midplane 100. They are illustrated for purposes of clarification by 21*a*, 21*b* in FIGS. 3 and 4 of the co-pending US provisional, as also the longer bead 20 is represented in more detail there with respect to the attaching tongue 31.

Figure 5:
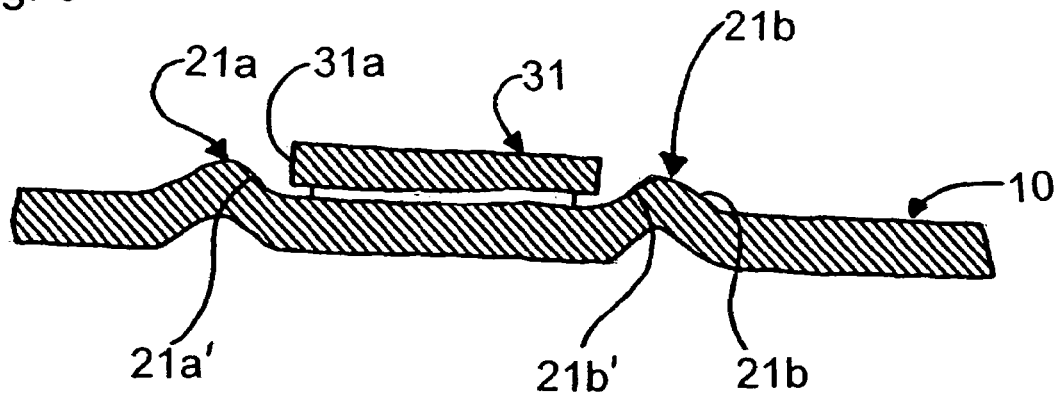
FIG. 5 shows an alternate view of the third stage of three stages in a manufacturing process of a sheet metal lid, which introduces, in part, an attaching tongue, tab, buckling line and open position.

FIG. 5 shows the rivet head in a forming process with a larger diameter than is shown in FIGS. 1*a* and 2*a*, wherein the tab 30 is placed over the rivet shaft. While the rivet head is forming, the tab 30 is attached to the panel 10 via the attaching portion 31, wherein the attaching portion 31 can be connected to the rest of the tab 30 through a buckling line 38.

Figure 6:
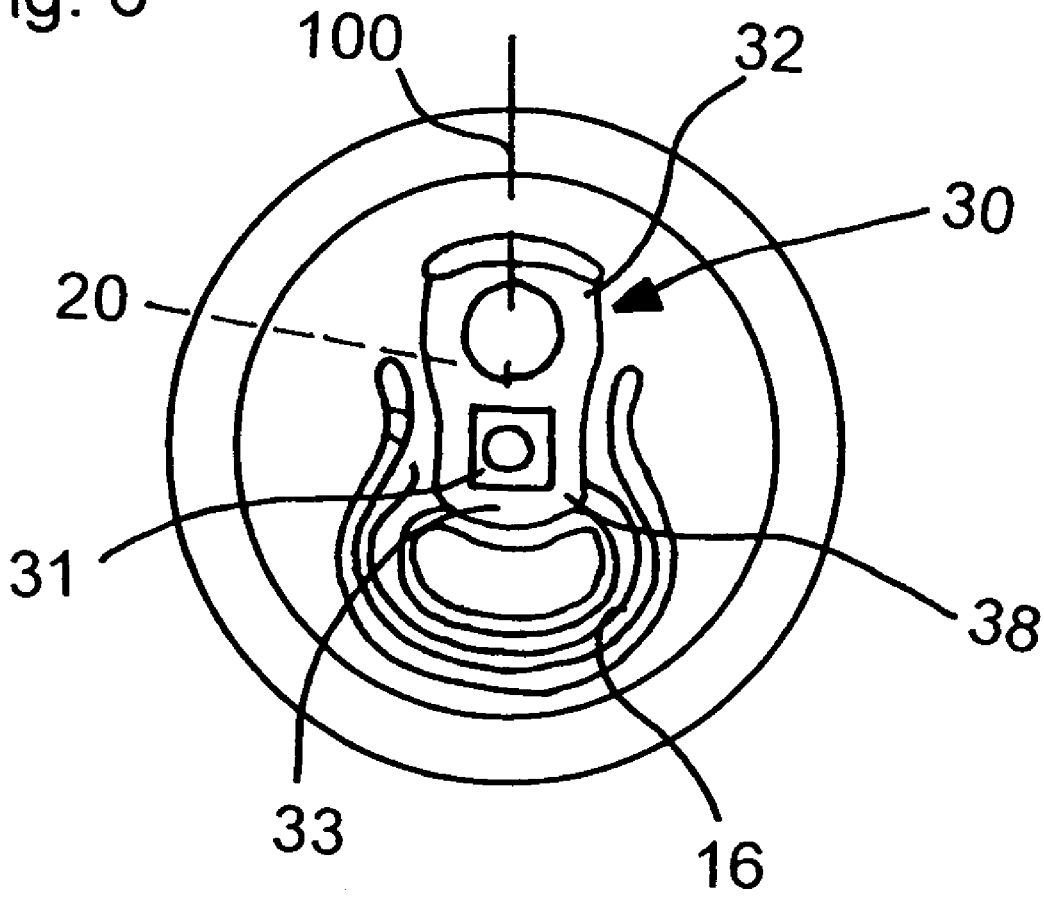
FIG. 6 is a cross section along a longitudinal plane 100, to illustrate a sharp front edge 20*a* of a strip-shaped or line-shaped projection 20.

FIG. 6 shows the asymmetry in a transverse direction to the longitudinal extension of the projection 20 (in the longitudinal plane 100 of the lid or the tab). Further, the projection 20 can be associated to the peripheral edge 31*c* of the attaching portion 31.

At one manufacturing station, the re-forming of the three beads 20 (or also 21*a*, 21*b*) is improved or designed more exactly. The "re-forming", results in a formation of the beads (projections) as used later for the positional fixing, according to FIG. 3*a* and the remaining figures of the main application. At the station, the at least one projection receives its correct profile geometry, after having been re-formed integrally from the sheet metal lid (the panel).

FIG. 6*a* shows the cross section extending in a longitudinal direction, as determined by the longitudinal midplane 100 for FIG. 6 as viewed in the bottom section. Further, the top illustration shows a preform 20*, in a two-stage manufacturing process prior to the second step (post-forming or re-forming).

The re-forming step comprises a designing shaping of the pre-form 20* with a coining (an embossing operation) for further flattening the top surface 20*c*. In the re-forming process, the tool is applied likewise from the top and from the bottom for the re-forming. The slight bend according to FIG. 6*a* that is detectable on the left in the rising flank of the pre-form 20* may be recognized in the lower final form, the way in which the sharp front edge 20" is introduced in the initially gently rising left incline of the shaped rampart 20* also being visible. To the right of the transverse plane 101, the second incline of the rampart is shaped from bottom to top, for forming a flat top side 20*c* starting approximately at the instep of the rampart 20* and leading gently over to the rest of the sheet metal panel 10 in portion 20*b*.

Additionally, in the final form, the attaching portion 31, which is mounted at the rivet 11, and the tab 30 are already attached according to FIG. 5, also in a sectional view. The tab is arranged with its intermediate web between the left opening and the grip opening 32*b*, substantially above the transversely extending projection 20. The two openings of the tab are shown in FIG. 5, one opening resulting from the formation of the attaching portion 31, which is further connected to the tab 30 via an articulation line 38, whereas the opening for inserting a finger is designed particularly.

The opening 32*b* is a part of the grip portion 32, the web 32*a* between the two openings being shown slightly bulged in FIG. 6*a*, having a front edge 32*c* that was related to the free edge 31*c* of the attaching portion 31 during manufacture. A major part of the projection 20 is thus located below the web and is barely visible from outside.

Figure 2:
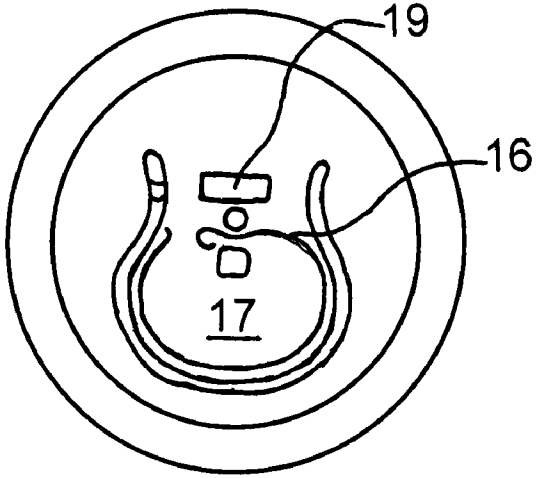
FIG. 2*a* shows the second stage of three stages in a manufacturing process of a sheet metal lid, which introduces, in part, a score line or weakening line and a mounting place.
Figure 3:
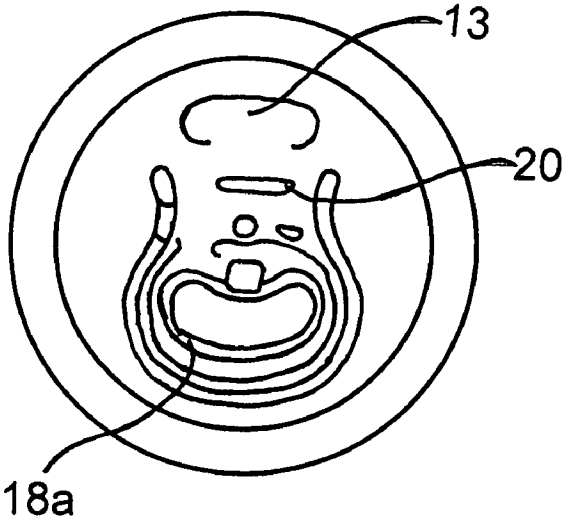
FIG. 3*a* shows the third stage of three stages in a manufacturing process of a sheet metal lid, which introduces, in part, an eyeball shaped bead, beads or projections and finger depression.

In this context, a modified sequence of the two-stage re-forming may be performed besides the processing sequence according to FIGS. 1*a* to 3*a* of the main application or of the first patent of addition, for example the initial introduction of the at least one pre-form, as illustrated by the pre-form 20* in the top picture of FIG. 6*a*, in a first working step, still without the introduction of score lines (as weakening lines), of which weakening line 16 is an example. For a projection 20 with a corresponding pre-form 20*, this is illustrated by the sequence of FIGS. 1*a*, 2*a*, 3*a*; the subsequent assembly can be identical to that illustrated in FIG. 5.

If multiple projections are used for blocking rotating movements all pre-forms 20* are shaped according to FIG. 1*a*. In the figure, only one projection is illustrated. The first score line is introduced only later, in a separate working step, e.g., after re-forming (further shaping) of the pre-shaped projection 20*. Here, the one projection receives its correct, assigned profile, as is shown in the bottom illustration of FIG. 6*a* of the main application. In this way, it can be realized that a scoring operation, which subjects the sheet metal to severe stress, is not performed at the same time as the shaping of the pre-form takes place in the first operation, the shaping considerably stressing the sheet metal lid. The score line may be introduced prior to or after the re-forming operation which also stresses the sheet metal. During re-forming as is shown in FIG. 6*a*, the wall thickness on the top side of the projection is reduced by about 10% to 15%, with simultaneous compression and solidification of the portion, which is achieved uniformly from top to bottom by the embossing operation (coining).

We claim:

1. A method for shaping a lid for a can, the lid composed of a panel having an openable area defined thereon by a score line and a mounting place for a tab, the method comprising;

shaping at least one line-shaped projection in the panel by;

(a) shaping a pre-form of the at least one line-shaped projection out of the panel, in which the pre-form is located near an attaching portion of the tab, but at a distance from the mounting place; and (b) re-forming at least a front wall of the preform;

wherein the shaping begins when no score line is arranged in the panel;

wherein the re-formed front wall is located and adapted to block against an outer edge of an attaching portion of the tab.

2. A method in accordance with claim 1, wherein:

the body is a beverage can.

3. A method in accordance with claim 1, wherein:

the score line is introduced into the panel after shaping the pre-form of the at least one projection in a subsequent station.

4. A method in accordance with claim 1, wherein:

the re-forming includes one of an embossing, flattening and stiffening a top side of the projection.

5. A method in accordance with claim 4, wherein:

the stiffening is a reduction of a sheet metal thickness by at least 10%.

6. A method in accordance with claim 1, wherein:

the score line is brought into the panel after re-forming the pre-form of the at least one projection in a subsequent station.

7. A method in accordance with claim 1, wherein:

the score line is brought into the panel after shaping of the pre-form of the at least one projection in the same panel, and prior to re-forming the pre-form of the at least one projection in the same panel.

8. A method in accordance with claim 7, wherein:

re-forming and shaping are done in one forming station.

9. A method in accordance with claim 1, wherein:

the at least one line-shaped projection in the panel is shaped twice.

10. A method in accordance with claim 1, wherein:

the score line defines the openable area of the panel as being less than an entirety of the panel.

11. A method in accordance with claim 1, wherein:

the attaching portion of the tab is a rivet island, so that the re-formed wall is located and adapted to block against the outer edge of the rivet island;

the outer edge of the rivet island being inward of an outermost peripheral edge of the tab;

the method further comprising staking the tab to the panel with the re-formed wall positioned beneath the tab and located to block the outer edge of the rivet island.

* * * * *

UNITED STATES PATENT AND TRADEMARK OFFICE

CERTIFICATE OF CORRECTION

PATENT NO. : 7,165,926 B2
APPLICATION NO. : 11/184007
DATED : January 23, 2007
INVENTOR(S) : Rieck et al.

It is certified that error appears in the above-identified patent and that said Letters Patent is hereby corrected as shown below:

Column 1:
Line 17, after the words "designated as," --a-- should be inserted.
Line 20, after the word "called" --a-- should be inserted.
Line 28, after the words "designated as," --a-- should be inserted.
Line 52, "("staking")" should be --(commonly referred to as "staking")--.
Line 67, "flank" should be --side--.

Column 2:
Line 1, "flank" should be --side--.
Line 17, "(rivet island)" should be --(i.e., rivet island)--.
Line 19, "may have strip shape (line shape)" should be --may have a strip shape (i.e., a line shape)--.
Line 62, "Reference is made to the content of the disclosure of the co-pending US application (as mentioned in the introductory part)." should be deleted.
Line 64, "The present invention" should be --The invention--.

Figure 7:
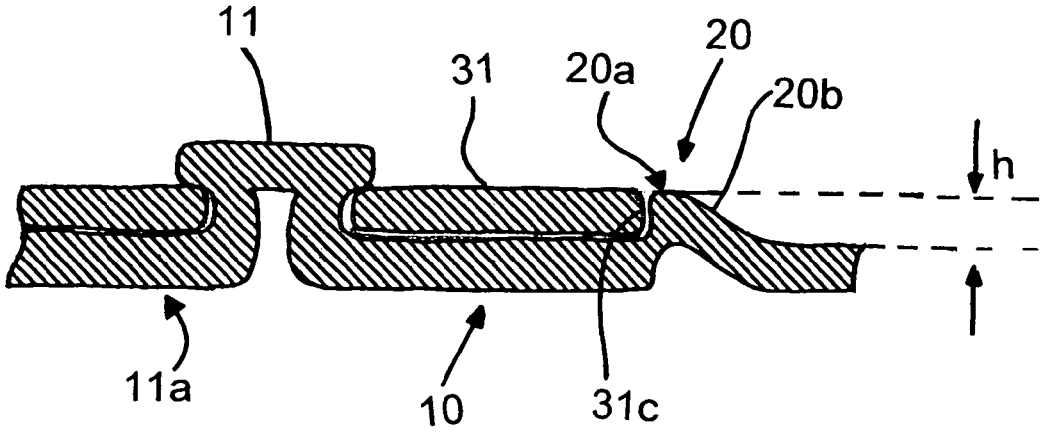
Figure 8A:
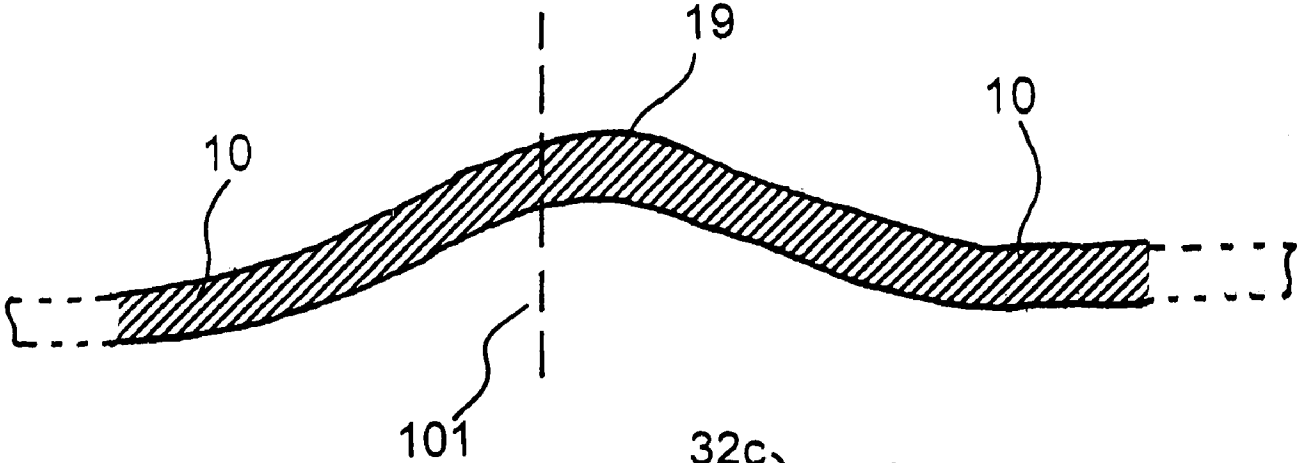
Figure 8B:
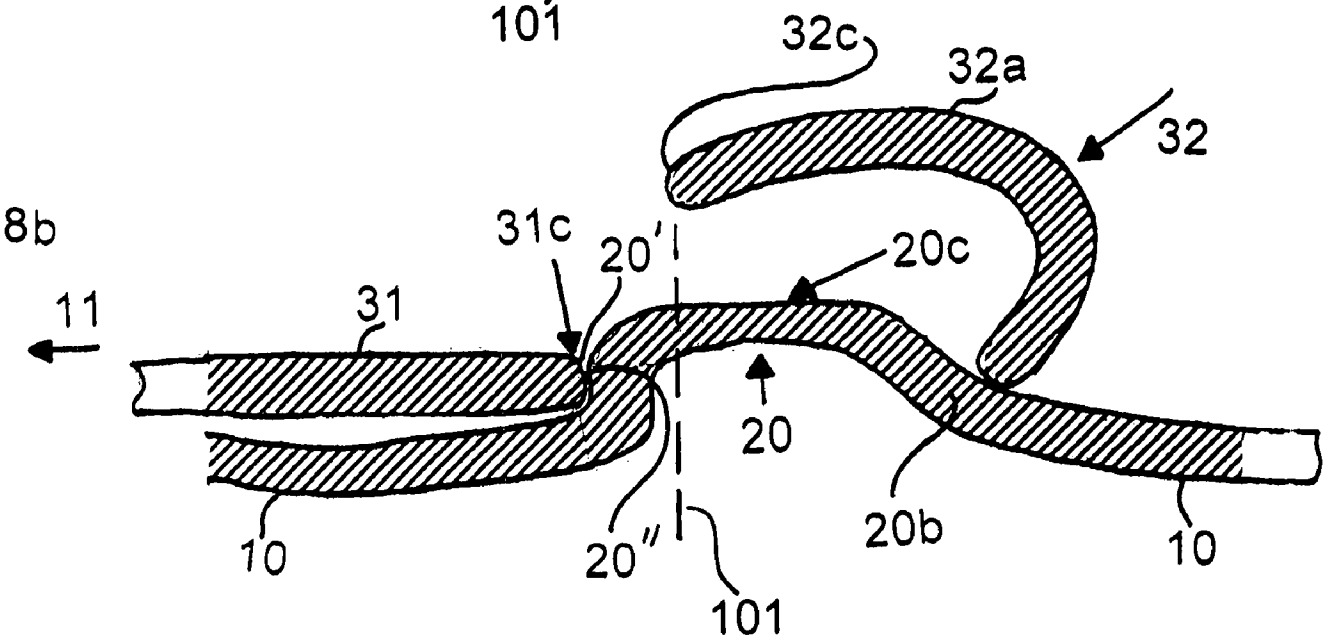

Column 3:
Line 1, "FIG. 1a" should be --FIG. 1--.
Line 4, "." should be --;--.
Line 5, "FIG. 2a" should be --FIG. 2--.
Line 8, "place, and;" should be --;--.
Line 9, "FIG. 3a" should be --FIG. 3--.
Line 16, "FIG. 4a" should be --FIG. 5--.
Line 16, "C-C" should be --5-5--.
Line 17, "FIG. 5" should be --FIG. 6--.
Line 21, "FIG. 6a" should be --FIG. 7--.
Line 21, "100" should be --100 of FIG. 6--.
Line 24, "FIG. 6a is a cross section" should be --FIGS. 8a and 8b are cross-sectional views in the manufacture--.
Line 25, "FIG. 6" should be --FIG. 7--.

Signed and Sealed this

Fifteenth Day of June, 2010

David J. Kappos

David J. Kappos
*Director of the United States Patent and Trademark Office*

Column 3 (continued):
Line 30, "FIGS. 1a to 3a" should be --FIGS. 1 to 3--.
Line 35, "FIG. 1a" should be --FIG. 1--.
Line 46, "FIG. 2a" should be --FIG. 2--.
Lines 47-49, after "11" the following should be deleted: ", which is visible more clearly in the sectional enlargements of the main application, is".
Line 49, "panel" should be --panel 10--.
Line 51, "portion" should be --portion 31--.
Line 56, "FIG. 2a" should be --FIG. 2--.
Line 60, "FIG. 2a" should be --FIG. 2--.
Line 65, "panel" should be --panel 10--.

Column 4:
Line 1, "planar, allowing" should be --planar or flat, allowing--.
Line 3, "parallel US provisional, which the complete content is made reference" should be --aforementioned related and commonly owned application, i.e. U.S. Patent Application No. 2006/0016815, disclosure of which is incorporated by reference thereto in its entirety--.
Line 8, "("staking")" should be --(staking)--.
Line 9, "According to the FIGS. 1a to 3a" should be --As shown in FIGS. 1-3--.
Line 10, "20 are re-formed as" should be --20, 21, 22 (see FIG. 4) is reformed as an--.
Line 11, "beads" should be --bead--.
Line 12, "mounting place" should be --area for mounting the rivet--.
Line 14, after "beads" the following should be inserted: --21 and 22 (see FIG. 4)--.
Line 15, the following should be deleted: "They are illustrated for purposes of clarification by 21a, 21b in FIGS. 3 and 4 of the co-pending US provisional, as also the longer bead 20 is represented in more detail there with respect to the attaching tongue 31.".
Line 19, "FIG. 5" should be --FIG. 6--.
Line 20, "FIGS. 1a and 2a" should be --FIGS. 1 and 2--.
Line 25, "FIG. 6" should be --FIG. 7--.
Line 31, "21a, 21b" should be --21, 22--.
Line 32, "re-forming," should be --re-forming--.
Line 34, "FIG. 3a and the remaining figures of the main" should be --FIG. 3 and as shown in various ones of the drawing figures of the aforementioned related--.
Line 38, "FIG. 6a" should be --FIG. 8a--.
Lines 40-41, "in the bottom section. Further, the top illustration" should be --also in FIG. 8b. Further, FIG. 8a--.
Line 41, "20*" should be --19--.
Line 44, "designing" should be deleted.
Line 45, "20* with a coining (an embossing operation)" should be --19 with a coining operation (i.e., an embossing operation)--.
Line 49, "FIG. 6a" should be --FIG. 8a--.
Line 49, "flank" should be --side--.

Column 4 (continued):
Line 50, "20*" should be --19--.
Line 50, "form," should be --form illustrated in FIG. 8b,--.
Line 52, "20*" should be --19--.
Line 56, "20*" should be --19--.
Line 60, "FIG. 5" should be --FIG. 6--.

Column 5:
Line 3, "FIG. 6a" should be --FIG. 8b--.
Line 9, "FIGS. 1a to 3a of the main application of the first patent addition" should be --FIGS. 1 to 3 herein or in the aforementioned related and commonly owned application--.
Line 12, "20* in the top picture of FIG. 6a," should be --19 in FIG. 8a,--.
Line 15, "20*" should be --19--.
Line 16, "FIGS. 1a, 2a, 3a" should be --FIGS. 1, 2, and 3--.
Line 17, "FIG. 5" should be --FIG. 6--.
Line 19, "20*" should be --19--.
Line 20, "1a" should be --1--.
Line 23, "20*" should be --19--.
Lines 24-25, "the bottom illustration of FIG. 6a of the main application" should be --FIG. 8b--.
Line 32, "FIG. 6a" should be --FIGS. 8a, 8b--.
Line 41 (Claim 1, Line 4), ";" should be --:--.
Line 43 (Claim 1, Line 6), ";" should be --:--.